US009615683B2

(12) United States Patent
Peacock

(10) Patent No.: US 9,615,683 B2
(45) Date of Patent: Apr. 11, 2017

(54) LIQUID-DISPENSING CONTAINER WITH SINGLE GIMBAL MECHANISM

(76) Inventor: Christopher James Peacock, Stow-Cum-Quy (GB)

( * ) Notice: Subject to any disclaimer, the term of this patent is extended or adjusted under 35 U.S.C. 154(b) by 0 days.

(21) Appl. No.: 13/885,173

(22) PCT Filed: Nov. 15, 2011

(86) PCT No.: PCT/GB2011/001601

§ 371 (c)(1),
(2), (4) Date: May 14, 2013

(87) PCT Pub. No.: WO2012/066279

PCT Pub. Date: May 24, 2012

(65) Prior Publication Data

US 2013/0240551 A1 Sep. 19, 2013

(30) Foreign Application Priority Data

Nov. 19, 2010 (GB) ..... 1019626.9

(51) Int. Cl.
*A47G 19/22* (2006.01)
*B65D 23/10* (2006.01)

(52) U.S. Cl.
CPC ..... *A47G 19/2266* (2013.01); *A47G 19/2205* (2013.01); *B65D 23/10* (2013.01); *B65D 23/104* (2013.01)

(58) Field of Classification Search
CPC .... B65D 23/10; B65D 23/104; B65D 23/106; B65D 23/108; B65D 25/28
USPC ..... 215/396–397; 220/752, 755, 757, 756, 220/766, 764, 710.5; 16/425, 436
See application file for complete search history.

(56) References Cited

U.S. PATENT DOCUMENTS

| | | | | |
|---|---|---|---|---|
| 392,105 | A | 10/1888 | Chapman | |
| 4,437,636 | A | 3/1984 | Mazzurco | |
| 4,819,843 | A | 4/1989 | Nakayama | |
| 4,972,982 | A | 11/1990 | Harbour | |
| 5,340,006 | A | 8/1994 | Li | |
| 5,489,055 | A | 2/1996 | Levy | |
| 5,664,718 | A | 9/1997 | Vine | |
| 5,823,385 | A * | 10/1998 | Cautereels | 220/762 |
| 5,996,957 | A | 12/1999 | Kurtz | |
| 6,269,949 | B1 | 8/2001 | Gottlieb | |
| 6,793,084 | B1 * | 9/2004 | Wunsch | 220/1.5 |
| 8,215,519 | B2 * | 7/2012 | Steininger | A47G 19/2272 215/11.4 |

(Continued)

FOREIGN PATENT DOCUMENTS

| | | |
|---|---|---|
| CN | 101461634 | 12/2007 |
| NL | 8 403 131 A | 5/1986 |

*Primary Examiner* — Anthony Stashick
*Assistant Examiner* — Robert Poon

(57) ABSTRACT

A household liquid-dispensing container such as a drinking vessel or a jug comprising a vessel (30) that is configured to hold a liquid and that has a base (37) on which it can stand, an opening (39) and at least one side (38); and a handle (50) that is configured to be held by a user and that is attached to a side of the vessel (38) by a joint that forms a single gimbal between the handle (50) and the vessel (30) and that allows the handle (50) to pivot about a single axis (21) that extends directly above the center of gravity of the vessel (30) when the vessel base (37) is standing on a horizontal surface; an optional baffle assembly (80) to reduce sloshing; and a lid (120).

17 Claims, 20 Drawing Sheets

(56) References Cited

U.S. PATENT DOCUMENTS

| | | | | |
|---|---|---|---|---|
| 2003/0197104 | A1 | 10/2003 | Heybl | |
| 2004/0238706 | A1 | 12/2004 | Mancuso | |
| 2007/0012707 | A1* | 1/2007 | Rattay | 220/762 |
| 2009/0078714 | A1 | 3/2009 | Peacock | |
| 2010/0084531 | A1 | 4/2010 | Schuchman | |

* cited by examiner

LIQUID-DISPENSING CONTAINER WITH SINGLE GIMBAL MECHANISM

BACKGROUND OF THE INVENTION

1. Field of the Invention

The present invention relates to a household liquid-dispensing container, such as a drinking vessel, flask or jug, comprising a vessel that is configured to hold a liquid and that has a base on which it can stand, an opening and at least one side; and, a handle that is configured to be held by a user and that is attached to a side of the vessel by a joint that forms a single gimbal between the handle the vessel and that allows the handle to pivot about a single axis that extends directly above the centre of gravity of the vessel when the vessel base is standing on a horizontal surface.

2. Background of the Invention

People experience difficulty when drinking from conventional liquid-dispensing containers, such as a drinking vessel, for many different reasons. People with tremor struggle to hold drinking vessels steady in mid-air; develop lower back pain when leaning over to drink from drinking vessels with straws in that are standing on a horizontal surface; and, develop neck pain when tilting their head back in order to connect their mouth with straws positioned in drinking vessels that are held in mid-air. People with arthritis, joint pain and limited dexterity and limited strength, struggle to control the tilting of a drinking vessel in conjunction with absorbing the liquid container's weight; and, also experience pain when drinking due to having to tilt wrist and neck. People with difficulty swallowing, often need to drink with their chin resting on their chest but struggle from being required to overextend the twisting of their wrist in order to pour their drink into their mouth. People with limited dexterity struggle to hold their drink with straws in upright, which makes it difficult to connect their mouth with the straw, and this results in relying on another person, such as a nurse, to help in order to perform the activity of drinking. People drinking whilst travelling in vehicles struggle to hold drinking vessels steady due to unpredictable motion of the vehicle, resulting in spillages and making it difficult to connect their mouth with the drinking vessel. People drinking whilst reclining back in a chair or resting horizontally in a bed, who may or may not be physically weak, struggle to carefully control the tilting of the drinking vessel at the same time as absorbing its weight and this results in spillages and tiredness from over concentration.

3. Description of Prior Art

Liquid-dispensing containers such as specialist drinking vessels that help people who find conventional drinking vessels difficult to use, often referred to as 'daily living aids', are known in the prior art, however they do not provide a liquid-dispensing container that comprises of a handle and a vessel configured to pivot about an axis and that together form a single gimbal joint.

Liquid-dispensing containers that use gimbals to stabilise drinking vessels are known in the prior art, however, they do not provide a liquid-dispensing container (a) that has a handle that is configured to be held by a user that is attached to a side of a vessel by a joint the comprises of a low friction bearing, (b) that forms a single gimbal configuration between the handle and the vessel, (c) that allows the handle to pivot about a single axis as opposed to multiple axis, (c) that enables the handle to rotate 360° about the said xis; (d) that has the handle attached to the side of a vessel by a single joint, (e) that includes a low friction bearing such as a ball bearing, roller bearing or bush placed between the handle and the vessel (f) that includes the accompaniment of a baffle to reduce liquid sloshing, (g) that includes the accompaniment of a lid.

U.S. Pat. No. 4,437,636, issued to Anthory Mazzurco & Richard L. Miller on Mar. 20, 1984, discloses a Self-Orientating Fluid Container Device which includes a handle and a pair of gimbals that stabilise the drinking vessel when resting on a surface. It also includes a locking mechanism that locks the gimbals when the device is lifted vertically by the handle, i.e. when a user wants to drink from the drinking vessel, he/she lifts the handle at a 0 degrees tilt to the vertical, which locks the gimbal to allow drinking. Unlike the present invention, the invention of the '636 patent (a) only stabilises the drinking vessel when it rests on a surface, (b) uses a two axis gimbal structure as opposed to a single axis gimbal structure and (c) doesn't include the use of ball-bearings to reduce frictional contact.

G.B. Pat. Application. GB071314.5, submitted by Christopher J. Peacock on Jul. 7, 2007, discloses a Stabilising and Locking Device which includes a handle attached within a set range of points to an outer ring that pivots about a middle ring that orthogonally pivots about a cradle within which a drinking vessel resides, and all parts made with such dimensions to enable the mechanism to lock when the handle is sufficiently turned to pour drinks into users' mouths. Unlike the present invention, the application GB071314.5 incorporates (a) a two axis gimbal as opposed to a single axis gimbal structure, (b) a locking feature, and (c) the restriction that the handle is unable to be rotated fully by 360° due to the locking feature of the device.

PCT. Pat. Application. WO 97/25271, submitted by Friedman on 31, Dec. 2006, discloses a Multi-Chamber Liquid Pouring Apparatus which includes a device to hold and pour two or more different liquids. Unlike the present invention, the application WO 97/25271 (a) has multiple handles, (b) comprises of handles that move about an axis that is orthogonal to the axis in the said invention, (c) doesn't use a low-friction bearing, and (d) is limited to a jug rather than a drinking cup.

C.N. Pat. Application. CN101461634, submitted by Qiang on 19, Dec. 2007, discloses a cup with a handle that can be placed in a standard position for drinking, then moved to a 180 degrees upside down position for carrying the cup when on the move. Unlike the present invention, the application CN101461634 (a) is intended for only 2 positions, (b) doesn't move freely under a low-friction bearing, (c) doesn't use a ball bearing, roller bearing or bush.

U.S. Pat. No. US2007/0012707, submitted by Rattay on 14, Jul. 2005, discloses a vessel with handle that pivots up and down besides the vessel. Unlike the present invention, the invention of patent '707, (a) doesn't include the use of a low-friction bearing, so is unable to properly counteract hand tremor, (b) doesn't use a ball bearing, roller bearing or bush, (c) comprises of handle that doesn't move 360 degrees about the axis in which it is attached to the vessel, (d) comprises of a handle that moves about an axis orthogonal to the axis in the present invention, such that the handle moves up and down as opposed to tilting besides the vessel, (e) comprises of a handle attached to the side of a vessel by two joints as opposed to a single joint, and (e) comprises of a handle that moves over the top of the vessel, as opposed to moving to the side of the vessel, and (f) makes the activity of carrying the cup easier as opposed to making the activity of drinking easier.

PCT. Pat. Application. U.S. Pat. No. 6,269,949, submitted by Gottlieb on 10, May 2000, discloses a stackable beverage container with a handle joined to the vessel at two points, that resides flush to the vessel when drinking, and thus the handle is not used for drinking, and when wishing to carry the vessel, the handle can be rotated above the vessel to more easily carry. Unlike the present invention, the invention of patent '949 (a) doesn't include the use of a low-friction bearing, so is unable to properly counteract hand tremor, (b) doesn't use a ball bearing, roller bearing or bush, (c) comprises of a handle attached to the side of a vessel by two joints as opposed to a single joint, (d) comprises of a handle that moves over the top of the vessel, as opposed to moving to the side of the vessel, (e) comprises of a handle that is used for carrying the cup, not for drinking, (f) comprises of a handle that is intended primarily to be used in two positions in the upward position for carrying and the lower position for drinking, as opposed to multiple positions, and (f) makes the activity of carrying the cup easier as opposed to making the activity of drinking easier.

Liquid-dispensing containers that use single gimbals to dispense liquid in the field of industrial machinery are known in the prior art, with particular reference to a blast furnace ladle for containing molten iron; however, they do not provide a liquid-dispensing container (a) that has a handle that can be held by a user, (b) can be used as a household appliance, such as for the activity of drinking, and (c) requires a handle to be held by a user in close proximity, such as within 20 cm, to the centre of gravity of the liquid-dispensing container.

The following patent documents pertaining to drinking vessel holders with gimbals (a) don't have handles that can be held by a user, so the device cannot be lifted to drink from, (b) they don't have a single axis gimbal structure, (c) they don't incorporate the gimbal inside the handle and (d) they don't use ball bearings to reduce frictional contact. Even when they have shafts for holding the gimbal mechanism, and even if such shafts were used as handles, they would not operate in the same way as the present invention because (a) they comprise of a two axis gimbal structure as opposed to a single gimbal structure and (b) are not held in place with the mechanism as detailed in the present invention. These patents are U.S. Pat. No. 2003/0,197,104, which issued to Randy Heybl & Brett Keshtkar on Oct. 23, 2003 and discloses a Gimballed and Adjustable Beverage Holder; U.S. Pat. No. 5,664,718, which issued to Michael P. Vine on Sep. 9, 2007 and discloses a Drink Holder; U.S. Pat. No. 5,489,055, which issued to Dror Levy on Feb. 6, 1996 and discloses a Cup Holder for Automobile; U.S. Pat. No. 5,340,006, issued to Tianhou Li on Aug. 23, 1994, discloses a Head-Supported Cup Holder which includes apparatus strapped to the user's head that supports a middle ring and an inner ring acting as a drink holder; U.S. Pat. No. 4,819,843, issued to Hiromichi Nakayama on Apr. 11, 1989, discloses a Drink Container Holder which includes a mounting ring having a gimbal structure within it with a middle ring and a cradle.

None of the above inventions and patents, taken either singly or in combination, is seen to describe the instant invention as claimed. Their respective defects as mentioned above are overcome by our invention as described forthwith.

STATEMENT OF INVENTION

A household liquid-dispensing container such as a drinking vessel, flask or a jug comprising of a vessel that is configured to hold a liquid and that has a base on which it can stand, an opening and at least one side; and a handle that is configured to be held by a user and that is attached to a side of the vessel by a joint that comprises a low friction bearing and forms a single gimbal between the handle and the vessel and that allows the handle to pivot about a single axis that extends directly above the centre of gravity of the vessel when the vessel base is standing on a horizontal surface.

SUMMARY OF THE INVENTION

The present invention discloses a household liquid-dispensing container, such as a drinking vessel or a job, incorporating a mechanism for holding a device in such a way that the vessel is stabilised using gravity when held in mid-air and that enables the vessel to be tilted easily into the mouth despite the handle remaining in its chosen position. It is complemented with a baffle to reduce liquid sloshing and a lid with a hole to drink through and to hold a drinking straw in place in the vessel.

One embodiment according to the present invention comprises of a vessel that is configured to hold a liquid and that has a base on which it can stand, an opening and at least one side; a shaft attached to the side of the vessel; a handle with a corresponding shaft recess, that is placed upon the shaft; a ball bearing placed between the shaft and the handle to ensure a low friction joint; a clip placed onto the shaft that engages with a projection within the recess in the handle to hold the handle captive on the shaft; and a cap to prevent contact with the mechanism. The handle is configured to be held by a user and is attached a side of the vessel by a joint that forms a single gimbal between the handle and the vessel and that allows the handle to pivot about a single axis that extends directly above the centre of gravity of the vessel when the vessel base is standing on a horizontal surface. The handle can rotate 360° bout the said axis. The device is used in conjunction with an optional baffle to reduce liquid sloshing; and a lid to hold a straw, reduce the flow of liquid and keep the fluid close to its desired temperature.

Another embodiment of the liquid-dispensing container according to the present invention is to replace the use of the ball bearing with a second larger rim inside the shaft recess in the handle, which may be made of low friction material, e.g. a fluorethylene polymer.

Another embodiment of the liquid-dispensing container according to the present invention, comprises of a vessel with a base, an opening and at least one side; a ball-bearing; a shaft attached to a side of the vessel, that the ball bearing is placed upon, but in this case the shaft has a click fit configuration at its tip in order to hold the ball-bearing captive; a handle which has a corresponding recess to hold the ball-bearing; and a nut that is screwed into the opening of the handle recess to hold the ball-bearing in place. Like other embodiments of the present invention, this creates a joint that forms a single gimbal between the handle and the vessel that allows the handle to pivot about a single axis that extends directly above the centre of gravity of the vessel when the vessel base is standing on a horizontal surface.

The advantages of the present invention are as follows: (a) the unwanted effect of tremor and unpredictable motion from drinking whilst moving in vehicles, in destabilising the liquid-dispensing container is minimised, because the vessel remains relatively upright under the force of gravity, whilst the handle is freely moving with the tremor or the motion of the vehicle; (b) the vessel remains upright under the force of gravity making it easier for people with limited dexterity to connect their mouth with the straw and not spill the liquid outside the vessel; (c) one hand can take the weight of the liquid-dispensing container with one hand holding the handle, whilst the other controls the tilting of the vessel, which may or may not have a straw in; thus making it easier for the user to connect their mouth with the straw or vessel, and consume the desired amount of liquid, without the need to tilt the hand or neck, thus minimizing pain in the wrist and neck, as well as increasing control over the tilting of the vessel for users with limited strength or for those who are reclining; (d) likewise, the vessel can be brought to the mouth and the rim of the vessel can be levered against the edges of the top lip of the user's mouth to enable easy pouring just by lifting the handle vertically upwards; (e) for people who use a straw, the vessel with a straw placed in it can easily be tilted to ensure the straw is easy to connect the user's mouth with. Thus tremor, joint pain, limited dexterity, unwanted movement from vehicle travel and tilting a vessel whilst a user recline are overcome in the present invention.

BRIEF DESCRIPTION OF THE DRAWING FIGURES

The figures on the drawings are briefly described as follows.

DETAILED DESCRIPTION

FIGS. 1-14 show one embodiment of the invention 10 in accordance with the present invention comprising of a cup assembly which is arranged to look and feel like a standard bone-china coffee cup; a baffle assembly; and, a lid assembly. The device according to the present invention can be arranged for use with many varieties of drinking vessel types, sizes and shapes; and can be used with and without the baffle assembly and lid assembly. To this end the present invention has a capacity of 1 liter or less, e.g. 0.8 liters or less, such as 0.6 liters or less and a capacity of at least 0.1 liters, e.g. at least 0.2 liters, such as 0.3 liters.

Figure 1:
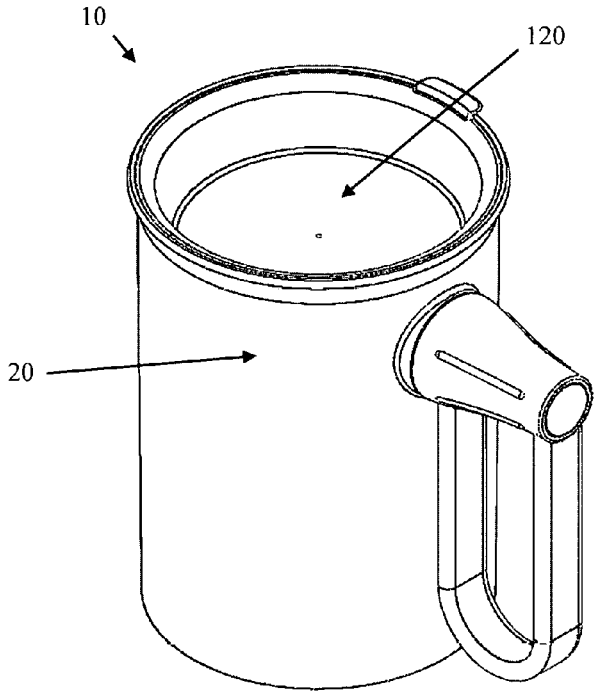
FIG. 1 is a perspective view of one embodiment of the present invention, with both a lid assembly and a baffle assembly placed inside a cup assembly.
Figure 2:
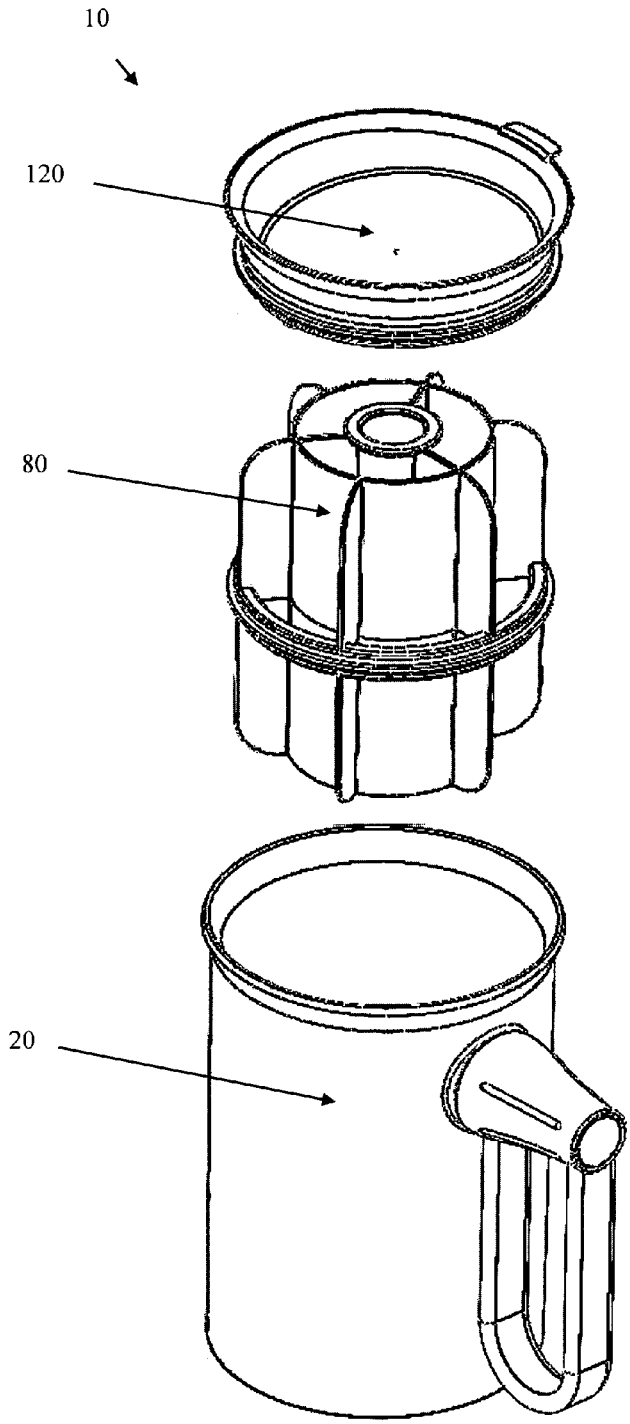
FIG. 2 is an exploded view of the three assembled parts that the device in FIG. 1 comprises of, including the lid assembly, the baffle assembly and the cup assembly.

The device 10 comprises of three assembled parts, namely a cup assembly 20, a baffle assembly 80 and a lid assembly 120. FIG. 1 illustrates the device 10 when the baffle assembly 80 and the lid assembly 120 are placed inside the cup assembly 20. As can be seen, the baffle assembly 80 is hidden from view by the cup assembly 20 and the lid assembly 120. FIG. 2 illustrates the device 10 when with the baffle assembly 80 is positioned directly above the cup assembly 20, such as might be seen before or after the baffle assembly 80 is placed inside the cup assembly 20. Likewise FIG. 2 illustrates the device 10 when the lid assembly 120 is positioned directly above the cup assembly 20, such as might be seen before or after the lid assembly 120 is placed inside the cup assembly 20.

The cup assembly 20, as illustrated in FIGS. 1-7, comprises of a vessel 30, a ball-bearing 40, a handle 50, a clip 60 and a cap 70. The vessel 30 is configured to hold a liquid and has a base 37 on which it can stand, an opening 39 and at least one side 38. The handle 50 is configured to be held by a user and is attached to a side 38 of the vessel 30 by a joint that forms a single gimbal between the handle 50 and the vessel 30 and that allows the handle 50 to pivot about a single axis 21 that extends directly above the centre of gravity of the vessel 30 when the vessel base 37 is standing on a horizontal surface.

Figure 3:
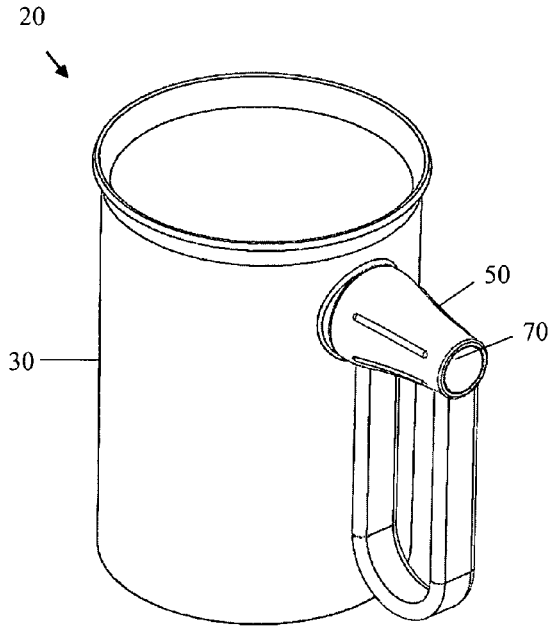
FIG. 3 is a perspective view of the cup assembly of the device in FIG. 1, without the lid and the baffle inside the cup assembly.
Figure 4:
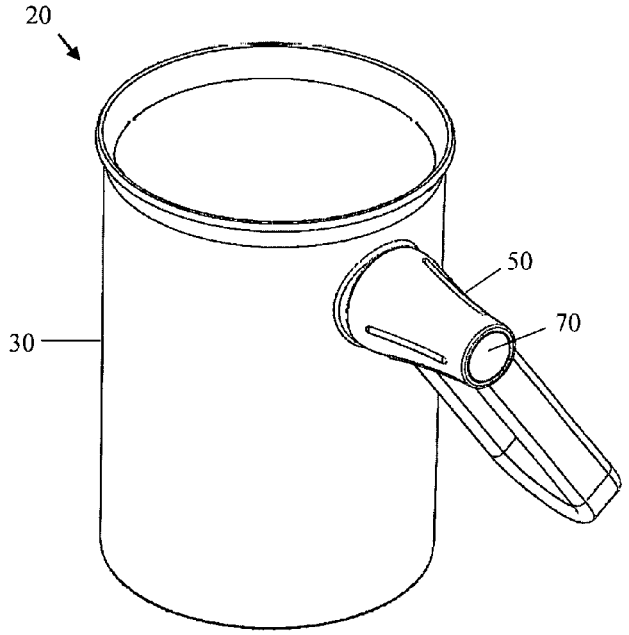
FIG. 4 is a perspective view of the cup assembly of the device in FIG. 1 when the handle has been rotated, to illustrate the handle's degree of rotational freedom about the vessel and how the vessel can remain upright due to gravitational forces despite the handle being rotated.
Figure 5:
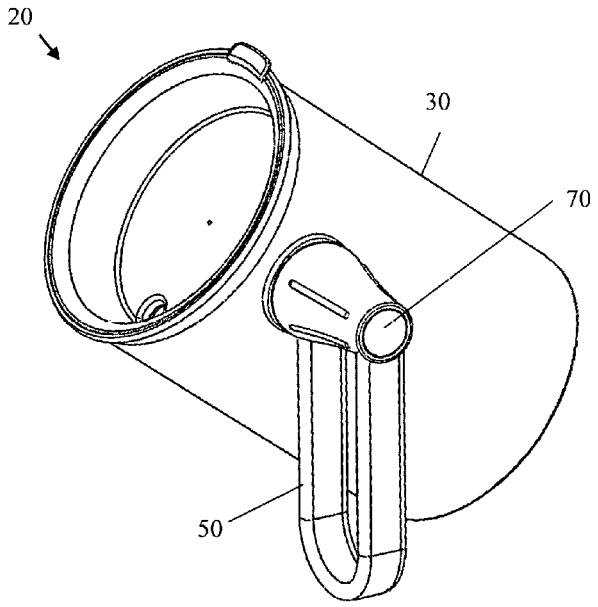
FIG. 5 is a perspective view of the cup assembly of the device in FIG. 1 when the vessel has been rotated, in this case to illustrate the vessel's degree of rotational freedom about the handle and how the handle can remain in one position whilst the vessel is tilted.

FIG. 3 is a perspective view of the vessel 30 and the handle 50 in its neutral position. FIG. 4 illustrates how the handle 50 can be rotated about an axis 21 and how the vessel 30 can remain upright under the force of gravity. This is particularly useful for people who find it difficult to hold drinking vessels upright and also for people with tremor who find it difficult to keep their drinking vessels steady. The gravitational force thus counteracts twisting motion in the handle due to tremor or holding the handle in an alternative positions by the user, and this is enhanced by the joint between the handle 50 and the vessel 30 configured to be held captive to one another in a low friction manner. FIG. 5 illustrates how the handle 50 can be held in a desired position by the user, such as in a vertically upright direction, and the vessel 30 be pivoted about the axis 21; and this pivoting happens by either by the user's other hand turning the vessel or by the user levering the rim 36 of the vessel 30 by using the sides of the upper lip of their mouth. This is particularly useful for people who find it painful or difficult to twist their wrists and tilt their head back, as is required when using conventional drinking vessels.

Figure 6:
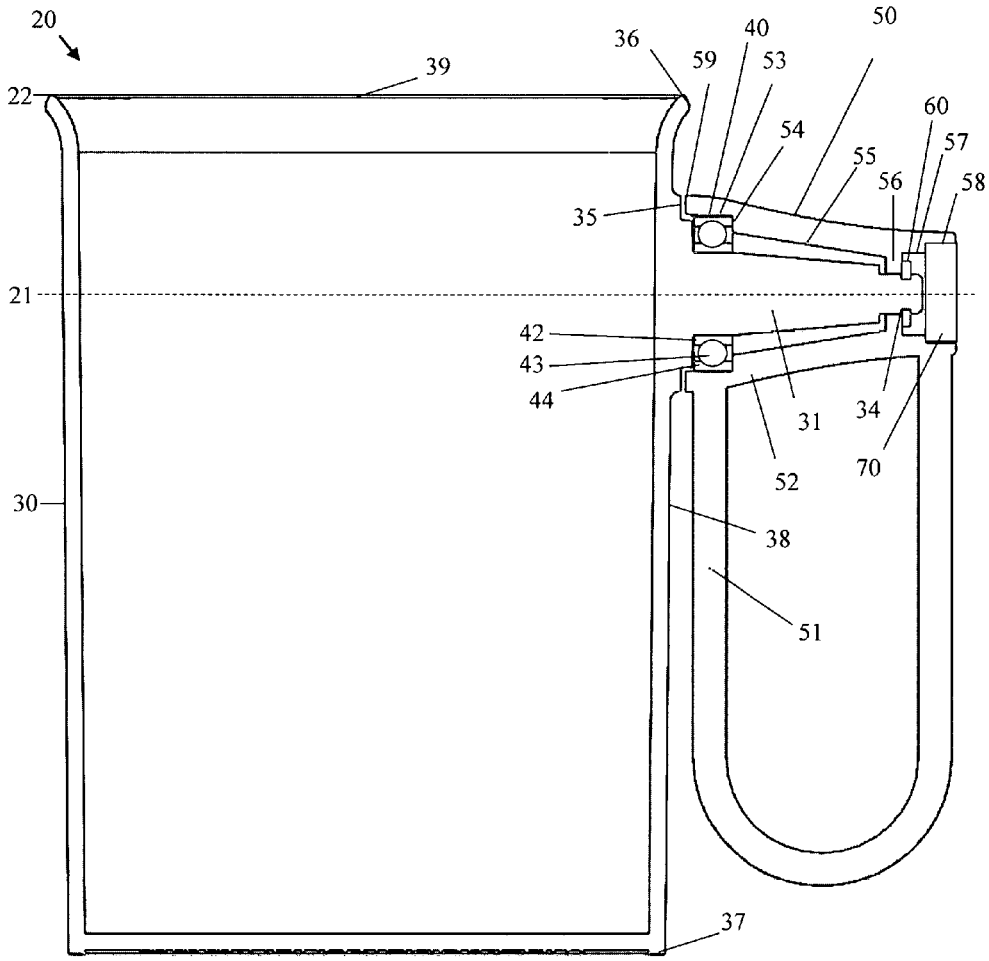
FIG. 6 is a side cross-sectional view of the cup assembly of the device in FIG. 1 to illustrate the mechanism that connects the handle to the vessel in a low friction manner.

FIG. 6 is a cross-sectional side view of the cup assembly 20 and illustrates the mechanism that enables the handle 50 to pivot about the vessel 30 in an axis 21 to form a single axis gimbal and to be connected together in a low friction manner. The vessel 30 has a shaft 31 that ensures the axis of rotation between the vessel 30 and the handle 50 is directly above the centre of gravity of vessel 30 when the vessel base 37 is standing on a horizontal surface.

Figure 7:
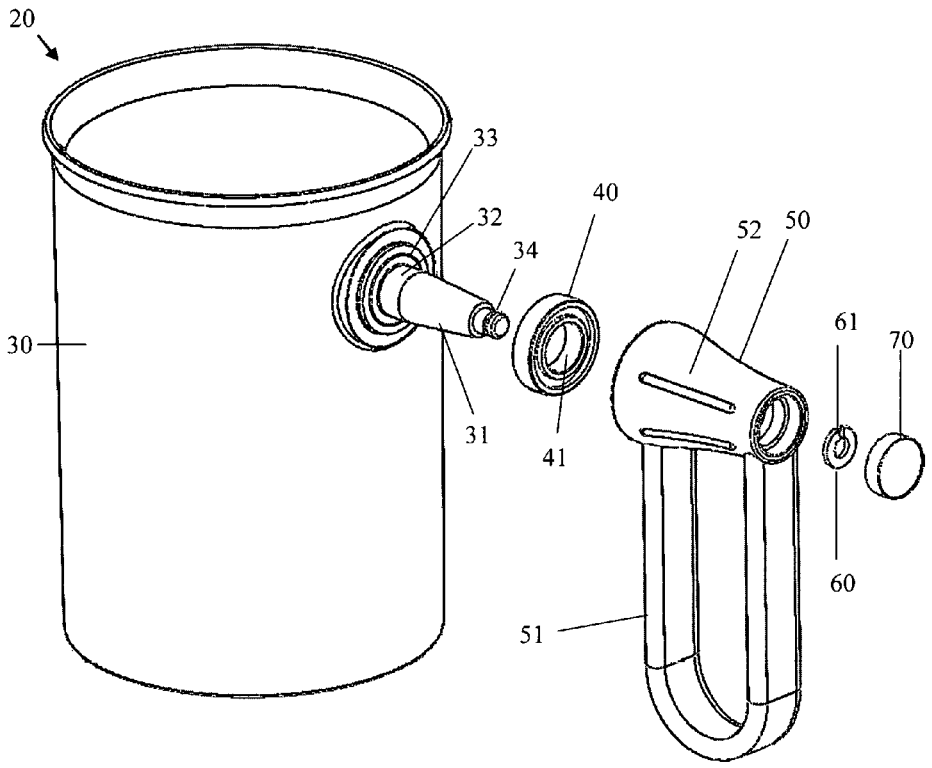
FIG. 7 is an exploded view of the cup assembly of the device in FIG. 1.

As illustrated in FIG. 6 and the exploded view of the cup assembly 20 in FIG. 7; a ball bearing 40 is pushed fitted on to the vessel shaft 31, so that the inside face of the ball-bearing 41 fits flush with the flat element of the vessel shaft near the base of the shaft 32; and the exterior face of the ball bearing's inner-cage 42 is pressed against the shaft base contact face for the ball-bearing 33. The ball-bearing 40 is now firmly in place and can only come loose if pulled directly away from the vessel 30. The ball-bearing 40 may or may not be made from food safe non-metallic materials such as plastic and glass in order for it to be able to be self-lubricating, be placed in a dishwasher, be placed in a microwave and be still functional even after soaked and washed in a sink. The ball-bearing 40 is a standard ball-bearing consisting of an inner-cage 42 that holds a series of balls 43 which are held in place by a standard ball-bearing retainer and that connect to an outer-cage 43.

In the present embodiment of this invention, the pivot axis 21 lies in a vertical plane that bisects the vessel 30 into two equal mass parts when the vessel base 37 is standing on a horizontal surface. The handle 50 consists of a handle loop 51 to hold the cup assembly 20. The handle loop 51 lies in a plane that also contains the pivot axis 21. The handle loop 51 in the present embodiment of this invention is a closed loop that extends around 360° and is elongated in the vertical direction, thereby allowing the handle loop 51 to be grasped by all four fingers of a user's hand, which is particularly helpful for users with limited strength. The handle loop 51 is attached to a recess in the handle 52. In other embodiments of the present invention the handle loop 51 may take the form of many shapes, which may or may not include a closed loop fitting as illustrated in the embodiment currently being described, for example the handle loop 51 could be an open loop, where the loop extends around at least 180°. Likewise, in other embodiments of the present invention, such as in the case of a wine glass, the handle loop 51 may not need to exist at all. However, in the majority of other embodiments of the present invention, a handle loop 51 is required.

The recess in the handle 52 includes a series of contours as follows; a ball-bearing outer-cage outside face receptor 53; a ball-bearing outer-cage exterior face receptor 54; a structural element 55; a handle's shaft receptor rim 56; a space creator 57 for the clip 60; and, a socket 58 to receive the cap 70. These contours are unified in their respective radial distances fully about the axis 21.

The recess in the handle 52 is placed over the vessel's shaft 31 and is pushed against the ball bearing 40. The outside face of the ball bearing's outer cage 44 makes flush contact with the ball-bearing outer-cage outside face receptor 53 and the exterior face of the ball-bearing outer-cage 44 makes flush contact with the ball-bearing outer-cage exterior face receptor 54. As shown in FIG. 7, the item 40 could be either a ball bearing or a roller bearing.

The structural element 55 makes no contact with the vessel's shaft 31. The handle's shaft receptor projection 56 makes frictional contact with the vessel's shaft 31 but there is a small gap between the two elements to ensure a low friction connection. The clip 60 is made of flexible but strong material and is a ring shape with a gap 61 in it. This gap 61 enables the clip 60 to expand and shrink in diameter, as and when required. This clip 60 is pushed over the end of the vessel's shaft 31 and then resides in the fluid container's shaft clip receptor 34 which is a small groove. The space creator 57 ensures the clip 60 has sufficient space to expand when it is pushed over the end of the vessel's shaft 31. The clip 60 has frictional contact with the handle's shaft receptor projection 56 but again there is a small gap between the two elements to ensure a low friction connection. This combination of elements thus connects the handle 50 to the vessel 30 in such a way that it remains held captive but free to pivot under low friction about an axis 21 to form a single axis gimbal. The weight of the vessel 30 and the fluid it contains is taken primary by the handle 50 through the ball bearing 40, and this accounts for the low friction nature of the mechanism in the present embodiment of this invention; and this is why it's possible to have a frictional point of contact between the handle's shaft receptor projection 56 and both the vessel's shaft 31 and the clip 60.

Finally a cap 70 is push-fitted into the recess in the handle 52 and makes contact with the socket 58. This hides the mechanism as well as prevents user contact with the mechanism. In this embodiment of the present invention, the cap 70 remains permanently in the recess of the handle 52 and can't be removed. In variations of this embodiment of the cup assembly 20 the cap 70 could be a removable part.

The handle 50 can be fully rotated about the pivot axis 21 by 360 degrees. This is helpful for people who have limited dexterity and prefer to hold the cup 20 in unusual positions. The recess in the handle's opening 59 does not make contact with the wide base element of the vessel shaft 35. Likewise the handle arm 51 doesn't make contact with the rim of the vessel 36. The rim of the vessel 36 is shaped as shown to make a lip shape in order to make the activity of drinking more pleasant and to reduce the chance of liquid falling down the exterior side of the device 30. The vessel base 37 consists of a small rim to enable the vessel 30 comfortably stand on a surface such as a table.

In a variation of this embodiment of the cup assembly 20, a compliant seal can be placed between the handle 50 and the vessel 30 in order to prevent unwanted liquid and particles from entering the recess of the handle 52. The seal would take the form of a rubber like material, but would have sufficient spacing between the compliant seal, the handle 50 and the vessel 30 so that the compliant seal would not prevent the handle 50 from moving freely about the vessel 30 in a low friction manner. However, the separate seal is not necessary if the gap between the vessel's shaft 31, wide base element of the vessel shaft 35 and the handle 50 is kept sufficiently small and/or if the bearing 40 is itself sealed.

In a further variation of this embodiment of the cup assembly 20, a second handle could be configured to be held by a user and that is attached to a side of the vessel 30 by a second similar joint that also forms a single gimbal between the second handle and the vessel and that allows the handle to pivot about the same single axis as the first handle.

In another variation of this embodiment of the cup assembly 20, a roller-bearing or a bush can be used in place of the ball-bearing.

Figure 8:
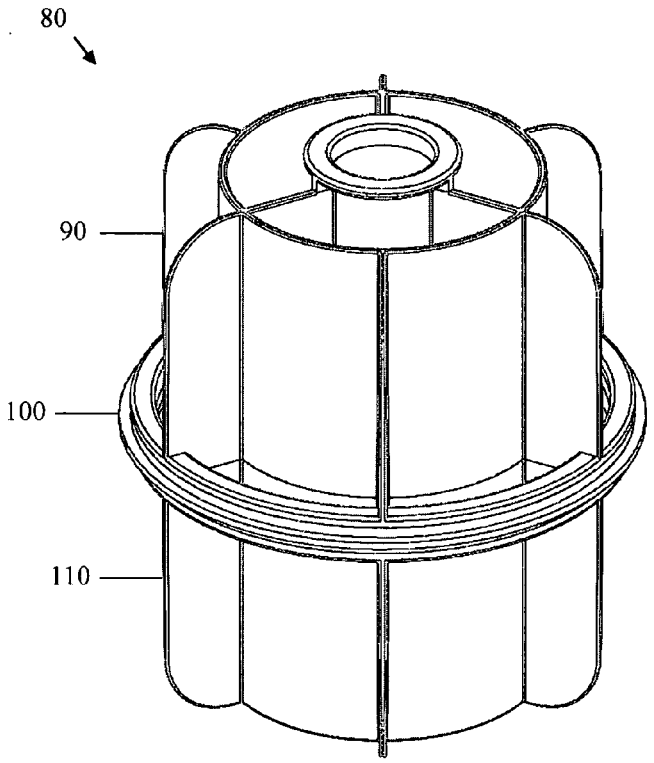
FIG. 8 is a perspective view of the baffle assembly of the device in FIG. 1.

FIG. 8 is a perspective view of the baffle assembly 80, which comprises of an upper baffle part 90, a compliant seal 100 and a lower baffle part 110. The baffle assembly 80 is an optional element of the device 10 and is inserted to the cup assembly 20 in order to reduce sloshing of liquid. The baffle assembly 80 reduces sloshing through dividing the interior of the vessel 30 into multiple interconnecting chambers. Reducing sloshing of liquid is useful for when the cup assembly is moved with a sudden jolt of the hand, such as what happens when drinking in a moving vehicle, or if tremor movement is exerted on the cup assembly by the user.

The baffle assembly 80 is different to other baffle solutions for liquid-dispensing containers currently commercially available because (a) its compliant seal 100 makes it easy to insert and extract from the cup assembly 20 and (b) it is has larger pockets of space, which assist with cleaning the baffle and putting finger tips in to insert and extract from the cup assembly 20, and (c) the compliant seal 100 retains the baffle assembly 80 within the vessel. However, the baffle assembly 80 could be made without the compliant seal 100, by making the baffle assembly 80 wider in order for it to engage the interior of the vessel 30, thereby retaining the baffle assembly 80 within the vessel 30.

Figure 9:
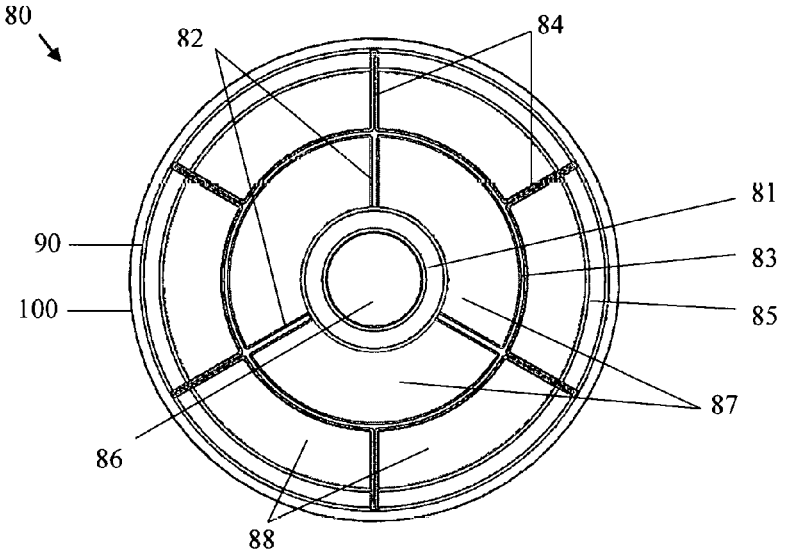
FIG. 9 is a top view of the baffle assembly of the device in FIG. 1.

FIG. 9 illustrates a top view of the baffle assembly 80. As can be seen, the baffle assembly 80 has an inner ring 81, connected by interior walls 82 to a middle ring 83 which in turn is connected by exterior walls 84 to an outer ring 85. This combination divides the fluid in the cup assembly 20 into chambers, namely, the inner chamber 86 within the inner ring 81; the middle chambers of space 87 between the inner ring 81, the interior walls 82, and the middle ring 83; and, the outer chambers 88 between the middle ring 83, the exterior walls 84 and the outer ring 85. When the baffle assembly 80 is partially or fully submersed in the fluid residing with the vessel 30 it confines the liquid within these respective chambers and thereby minimises the sloshing of the liquid out of the cup assembly 20.

Figure 10:
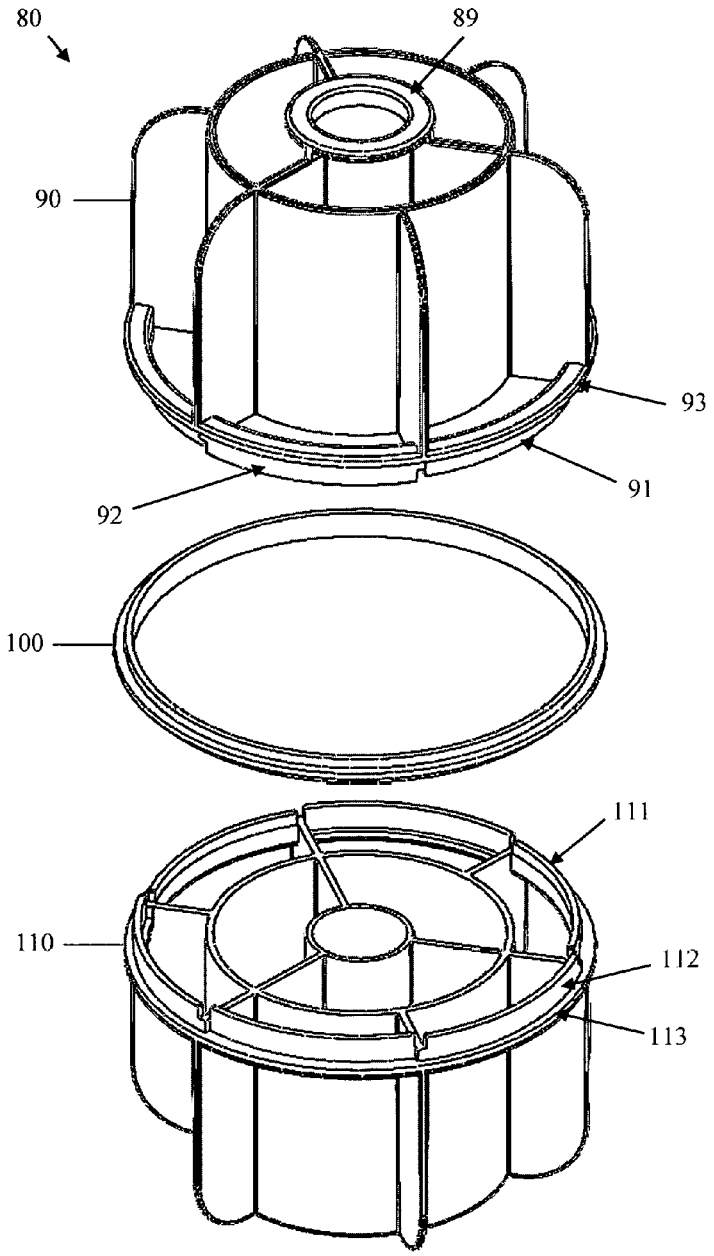
FIG. 10 is an exploded view of the baffle assembly of the device in FIG. 1.
Figure 11:
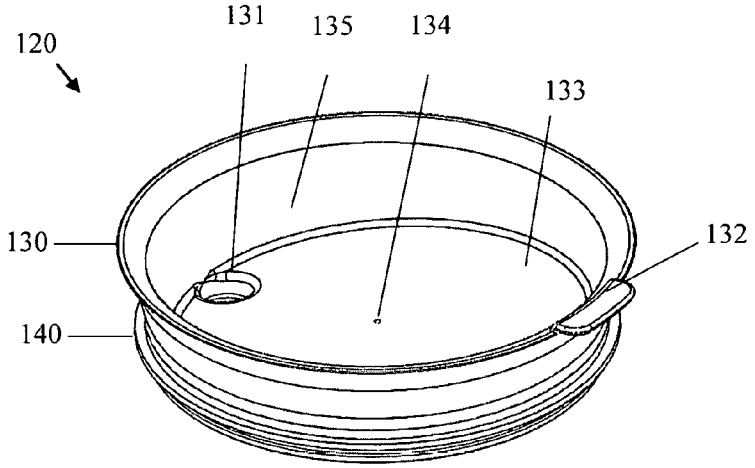
FIG. 11 is a perspective of the lid assembly of the device in FIG. 1.
Figure 12:
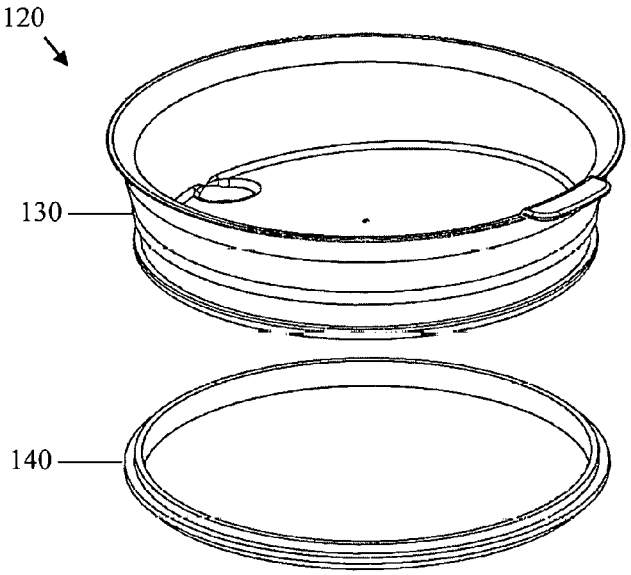
FIG. 12 is an exploded view of the lid assembly of the device in FIG. 1.
Figure 13:
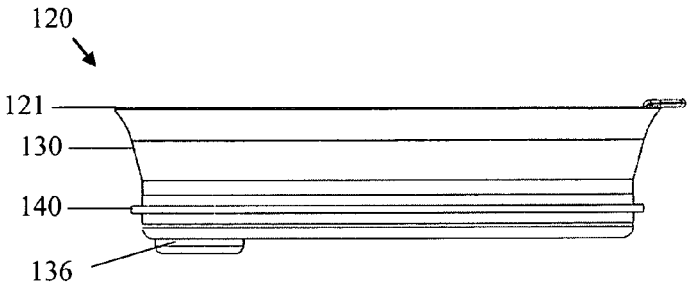
FIG. 13 is a side view of the lid assembly of the device in FIG. 1.
Figure 14:
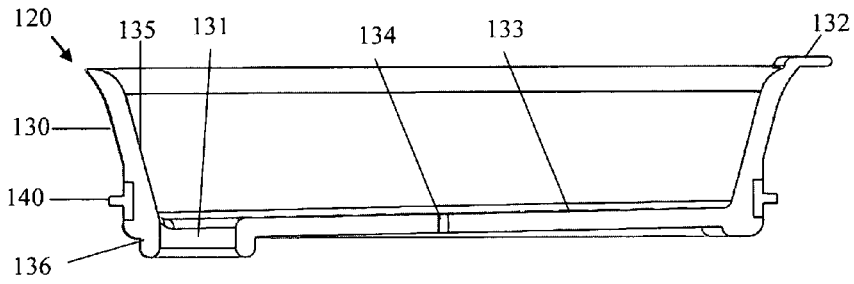
FIG. 14 is a cross-sectional view of the lid assembly of the device in FIG. 1.

FIG. 10 illustrates an exploded view of the baffle assembly 80. The upper baffle part 90 becomes permanently fixed to the lower baffle part 110 by simply pushing the two parts together. This is made possible through a push fitting arrangement comprising of inner teeth 91, 111 and outer teeth 92, 112. The upper baffle part 90 and the lower baffle part 110 in the present embodiment are exactly the same shape and dimensions. The compliant seal 100 is made of a flexible material such as food safe silicon rubber and due to its elasticity can be stretched over the upper baffle part 90 or lower baffle part 110 and placed inside and be refined in the purpose made groove created by the outer teeth 92, 112, and the outer rim 93, 113. The overhanging rim 89 of the inner ring 81 enables the baffle to be gripped for easy inserting and extracting from the cup assembly 20, and due to the surface area created, branding of the product can be placed here.

FIGS. 11-14 illustrate an embodiment of the lid assembly 120 comprising of a lid part 130 and a compliant seal 140. The compliant seal 140 makes the lid assembly 120 easy to insert and extract from the cup assembly 20, as well as ensure liquid only escapes from the cup assembly 20 through the drinking hole 131 and the air hole 134. The lid assembly 120 is also an optional element of the device 10 and is inserted to the cup assembly 20 in order to insulate the liquid and keep warm if the fluid is warm, or keep cold if the fluid is cold. It also serves to reduce the chances of spilling the drink accidently, gives a place to hold a standard sized disposable straw in an upwards direction and the lid assembly also enables increased control of the amount of liquid the user receives in their mouth. In a variation of the embodiment of the lid assembly 120, the lid part 130 is shaped such that at least part of it can engage the interior of the vessel, thereby retaining the lid assembly within the vessel, without the use of the compliant seal 140.

The drinking hole 131 is placed near the interior wall of the lid 135 to enable the fluid to be easily poured out of the device 10 and into the users' mouth. The drinking hole 131 is sized to easily fit and moderately hold a standard disposable drinking straw. A small ring 136 is positioned beneath the drinking hole 131 to guide and hold the drinking straw upright. The air hole 134 enables the fluid to easily flow out through the drinking hole 131.

The interior wall of the lid 135 is curved to make pouring of the fluid easy as well as to aesthetically look similar to the inside of the cup assembly 20. The tab 132 protrudes over the rim 22 of the cup assembly 20 to enable the lid assembly 120 to be easily extracted from the cup assembly 20, as well as be twisted within the cup assembly 20 so that the drinking hole 131 is at the desired position for drinking. The upper surface of the lid 133 is slightly angled towards the drinking hole 131 to ensure excess fluid returns into the cup assembly 20. The top rim of the lid assembly 121 is designed to fit flush with the rim 22 of the cup assembly 20, and the rest of the lid assembly 120 is designed to reside below the rim 22 of the cup assembly 20, so that apart from the tab 132, the lid doesn't protrude from the cup and is more hidden from view when the container is viewed by the user from the side. The top surface of the lid 133 is sufficiently far beneath the top of the lid assembly 121 to not overly make contact with the users' upper lip of their mouth when the vessel 30 is tilted during the activity of drinking.

Figure 15:
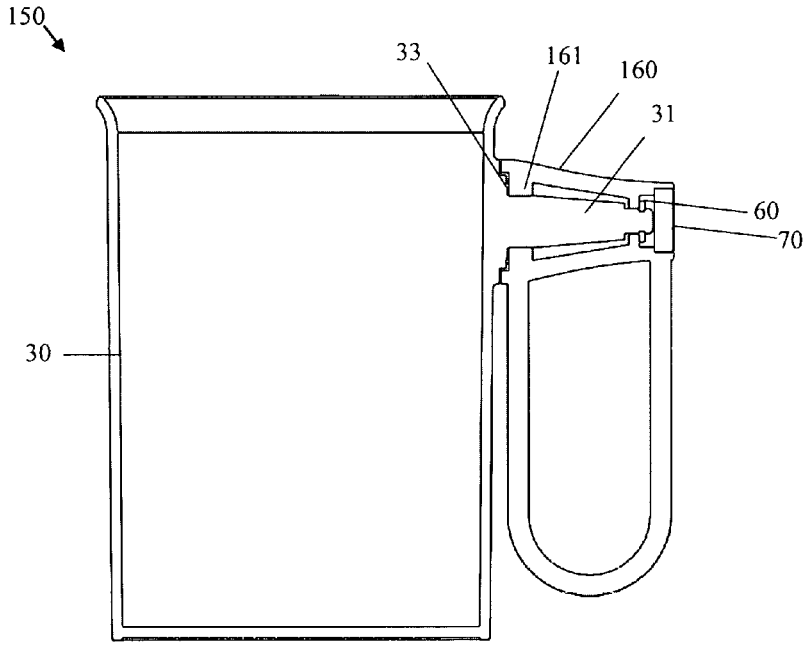
FIG. 15 is a side view of an alternative embodiment of this invention that uses no ball bearings.
Figure 16:
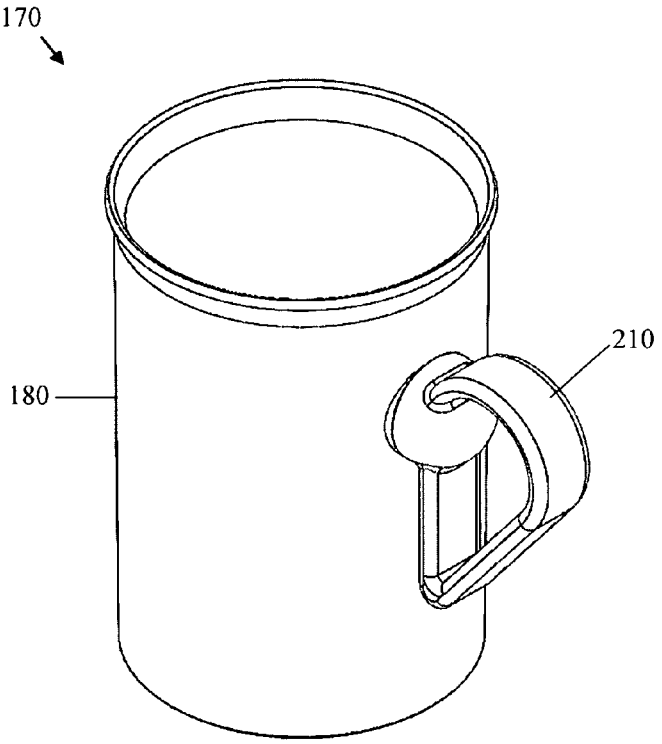
FIG. 16 is a perspective view of a further embodiment of this invention.
Figure 17:
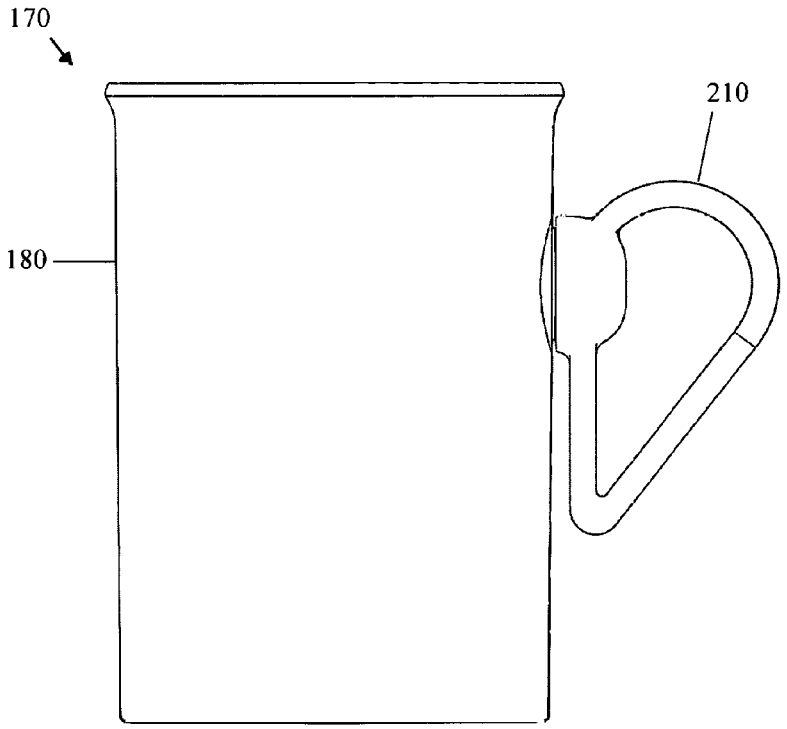
FIG. 17 is a side view of the device in FIG. 16.
Figure 18:
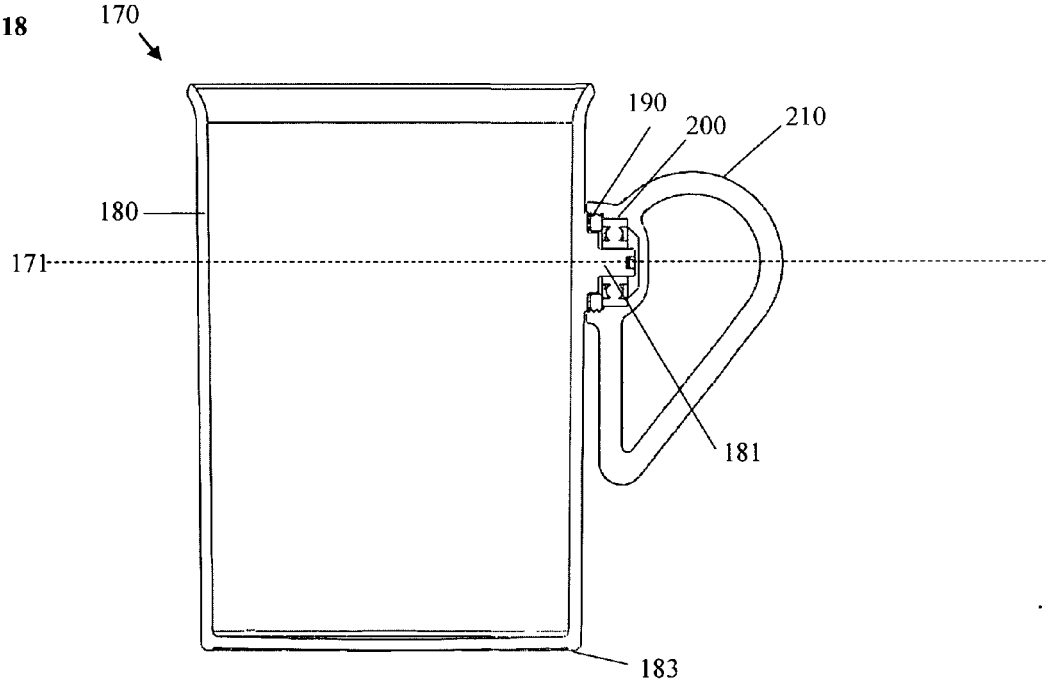
FIG. 18 is a cross-sectional view of the device in FIG. 16.

A second embodiment 150 of the original cup assembly 20 is illustrated in FIG. 15. In this alternative embodiment 150, there is no ball bearing 40 as it is replaced with a second projection, or bush, 161 within the recess of the handle 52. This second projection 161 makes frictional contact with the vessel's shaft 31 and the shaft base contact face for the ball-bearing 33. However, a small gap between the second projection 161 and the vessel's shaft 31 is present in order to minimize friction. This second embodiment 150 could be made of a low friction material, e.g. a fluoroethylene polymer. In a variation of the alternative embodiment 150, the vessel 30 can have a low friction material fixed on the vessel's shaft 31 and handle 160 can have a low friction material fixed in the recess of the handle 52 thereby also forming a bush. The low friction material enables the joint to be a low friction bearing.

Figure 19:
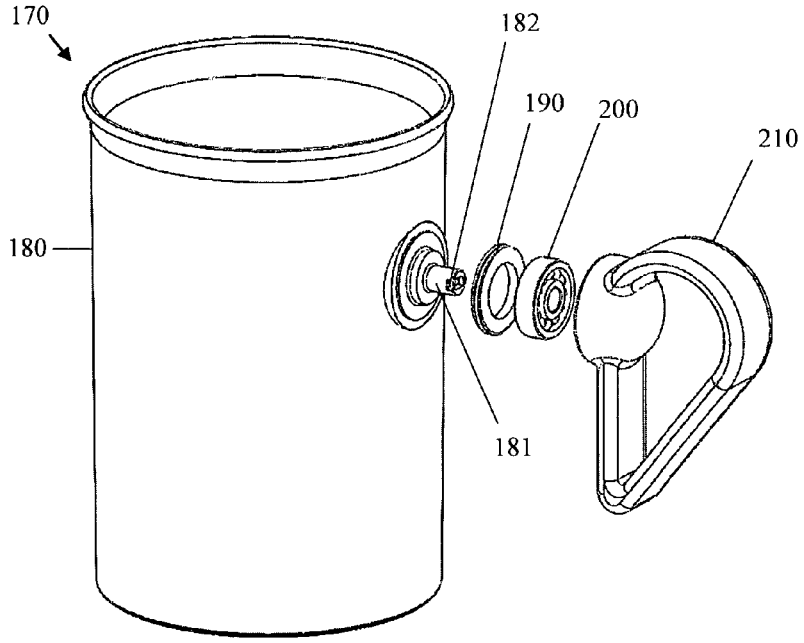
FIG. 19 is an exploded view of the device in FIG. 16.
Figure 20:
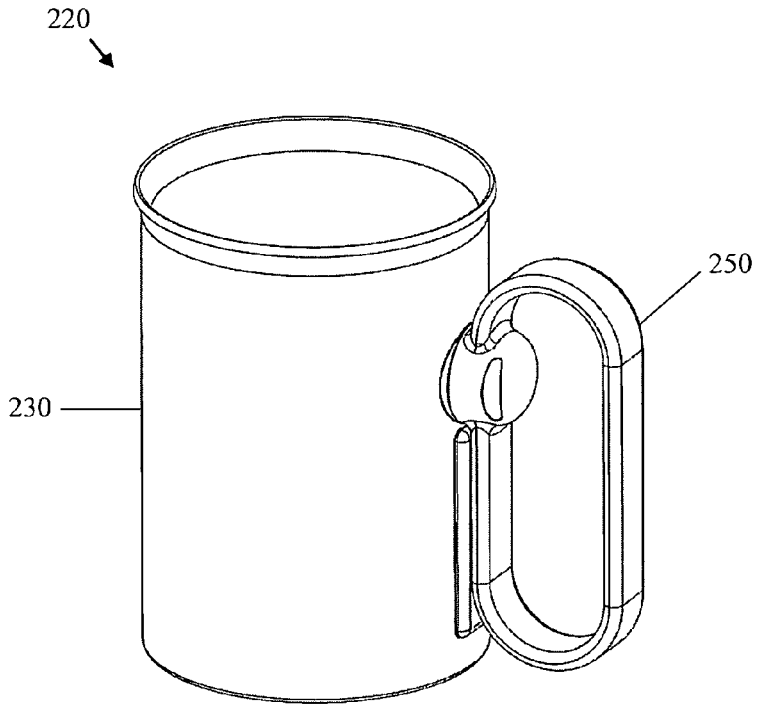
FIG. 20 is a perspective view of an alternative embodiment of this invention.
Figure 21:
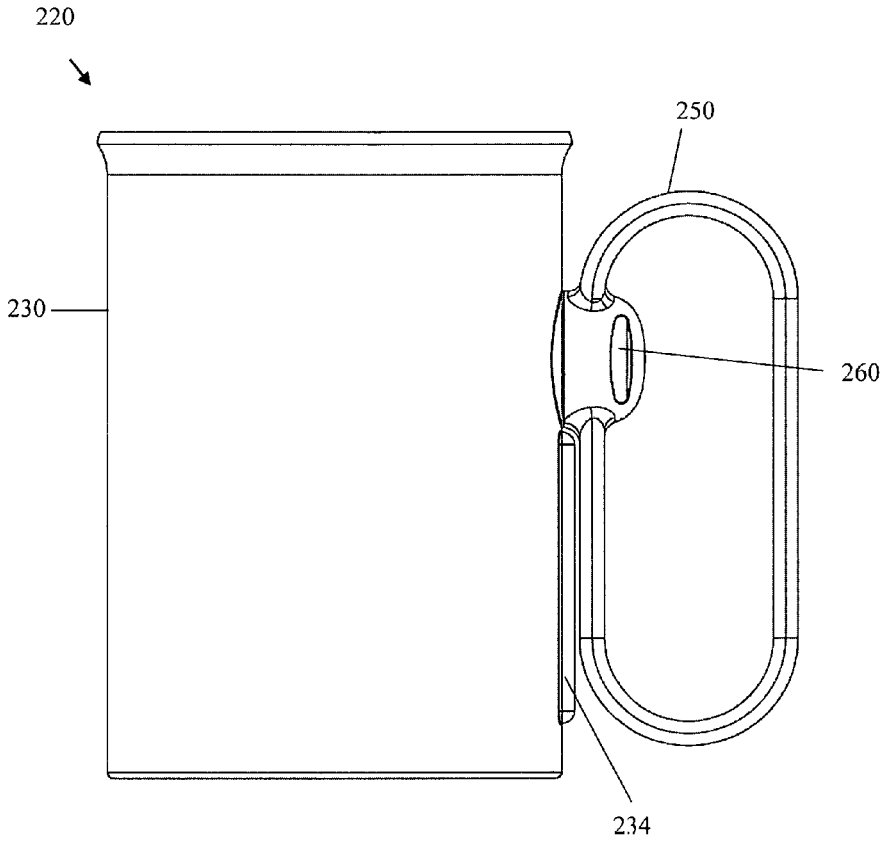
FIG. 21 is a side view of the device in FIG. 20

A third embodiment 170 of the original cup assembly 20 is presented is illustrated in FIGS. 16-19. The third embodiment 170 comprises of an alternative vessel 180, a nut 190, a ball bearing 200 and a handle 210. The handle 210 has a cavity within which the ball bearing 200 resides. The cavity opening has a screw groove that the nut 190 is screwed on to. This fixes the ball bearing in place. The handle 210, with the ball bearing 200 and the nut 190 is pushed onto the vessel's shaft 181, and is held in place by a click fit configuration 182 at the end of the vessel's shaft 181. This enables the handle 120 to pivot about an axis 171 with the vessel 180 to together form a single gimbal, with the axis extending directly above the centre of gravity of the vessel when the vessel base 183 is standing on a horizontal surface, as well as remain captive to the vessel 180. As shown in FIG. 19, the bearing 200 could be a depiction of a ball bearing or a roller bearing.

Figure 22:
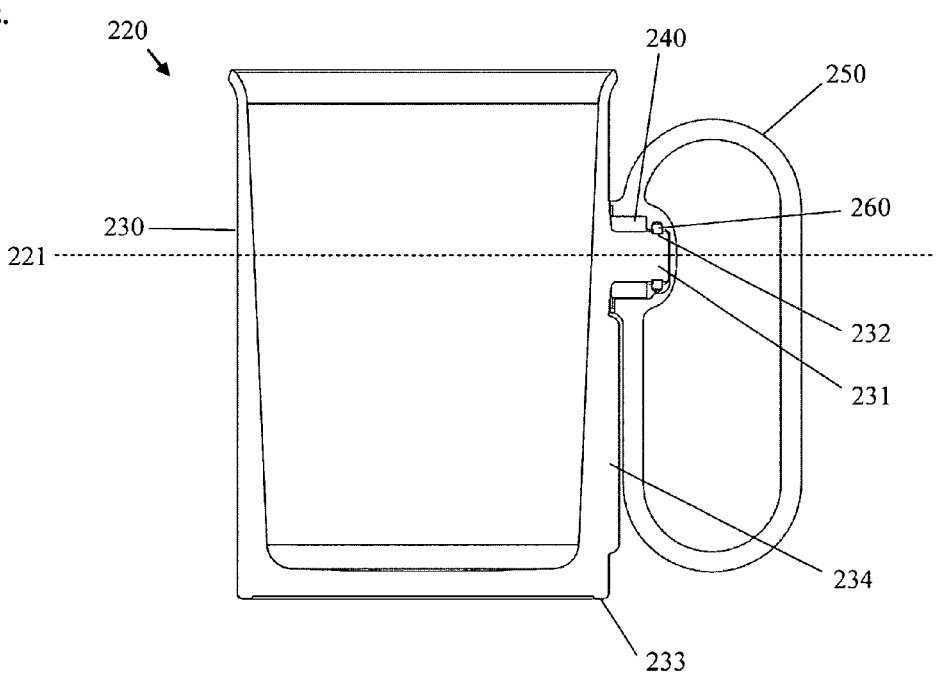
FIG. 22 is a cross-sectional view of the device in FIG. 20
Figure 23:
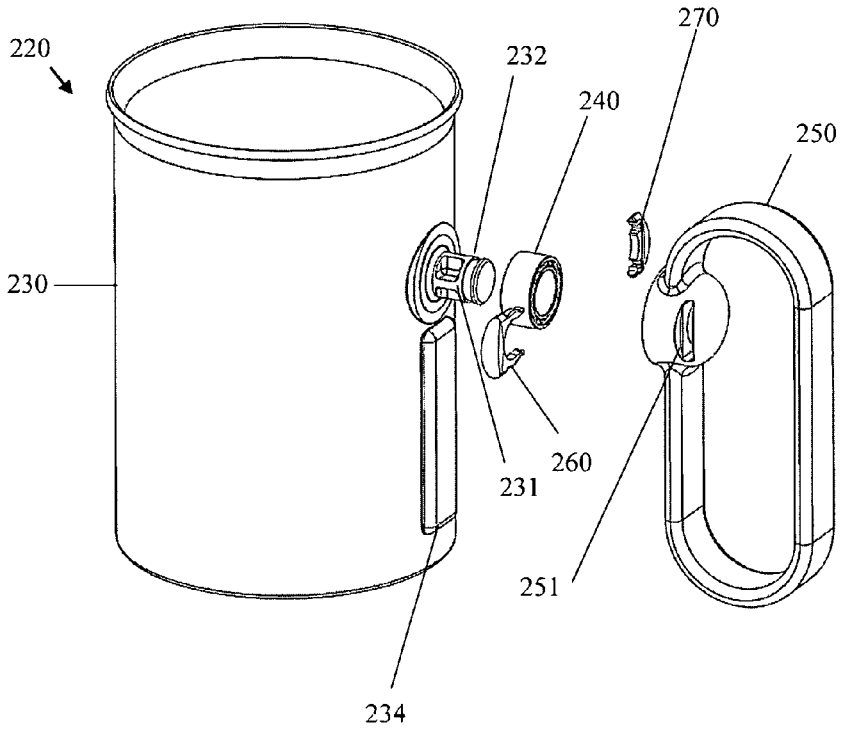
FIG. 23 is an exploded view of the device in FIG. 20
Figure 24:
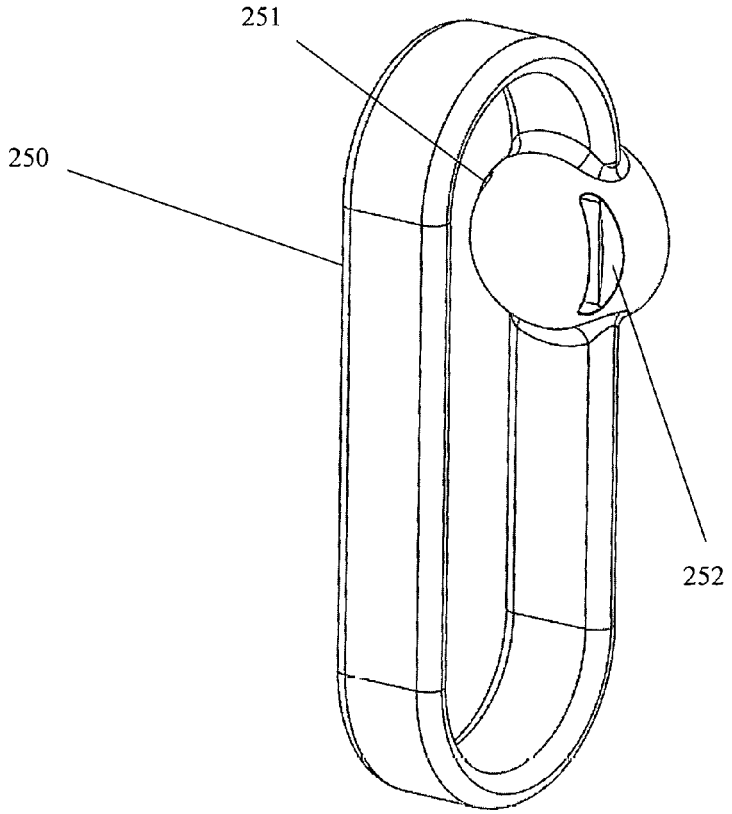
FIG. 24 is a perspective view of the handle of the device in FIG. 20
Figure 25:
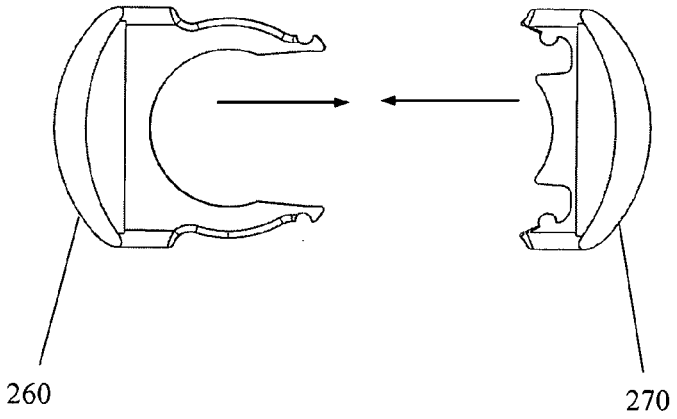
FIG. 25 is a side view of the male and female clips of the device in FIG. 20.

Turning now to a fourth embodiment of the present invention 220 of the original cup assembly 20 is presented in FIGS. 20-25. The fourth embodiment 220 comprises of an alternative vessel 230, a ball bearing 240, a handle 250, a male clip 260 and a female clip 270. The handle 250 has a cavity within which the ball bearing 240 resides. The handle 250, with the ball bearing 240, is pushed onto the vessel's shaft 231, and is held in place by entering the male clip 260 into the male clip receptor in the handle 251 and the female clip 270 into the female clip receptor 252 on the otherside of the handle. As shown in FIGS. 22 and 23, the bearing 240 could be a depiction of a ball bearing or a roller bearing. The male clip 260 and the female clip 270 make contact with the shaft groove 232 within the vessel's shaft 231 to hold the handle 250 captive to the vessel 230. The male 260 and female clip 270 are configured to click fit into one another, so to ensure they remain captive to the handle 250. This configuration enables the handle 250 to pivot about an axis 221 with the vessel 230 to together form a single gimbal, with the axis extending directly above the centre of gravity of the vessel when the vessel base 233 is standing on a horizontal surface. It also enables the handle 250 to pivot about the axis 221 with a low level of friction. The vessel 230 also has a thumb pad 234 to enable the user's thumb to be placed on the thumb pad 234 to lock the vessel in relation to the handle 250 in order to provide an additional and helpful method for tilting the vessel 230 when pouring its contents out.

Figure 26:
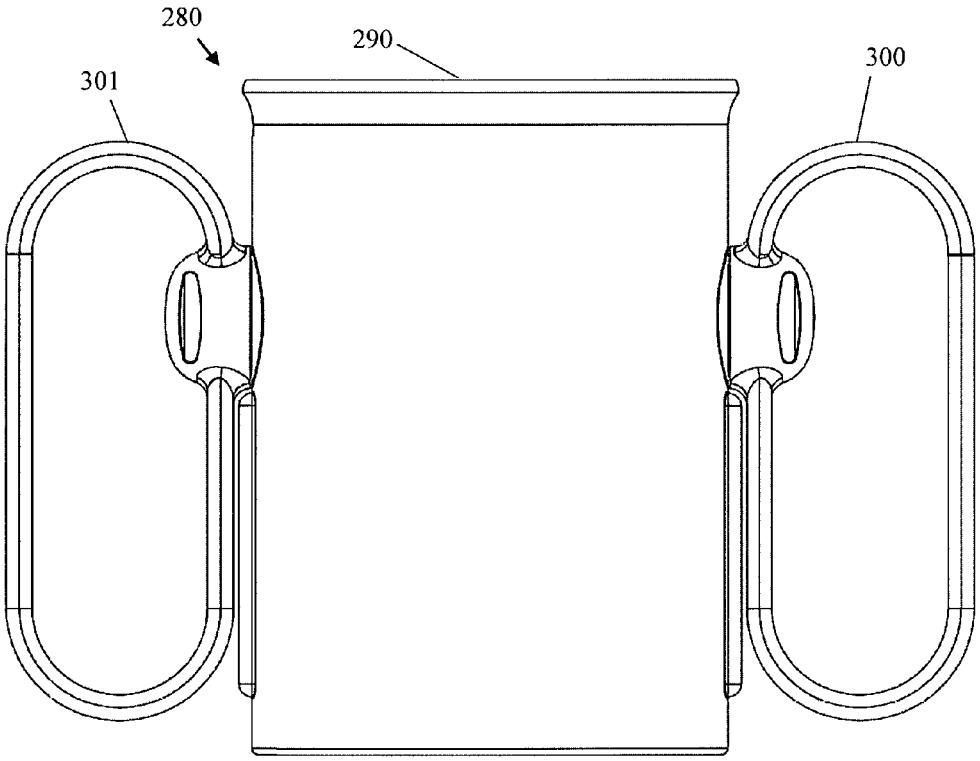
FIG. 26 is a view of an alternative embodiment of this invention that has two handles.

Now turning to the fifth embodiment of the present invention 280 of the original cup assembly 20 is presented in FIG. 26. The fifth embodiment 280 comprises of an alternative vessel 290 with a second joint that also forms a single gimbal between the second handle 301 vessel and the vessel and that allows the handle to pivot in a low friction manner about the same single axis as the first handle 300.

Figure 27:
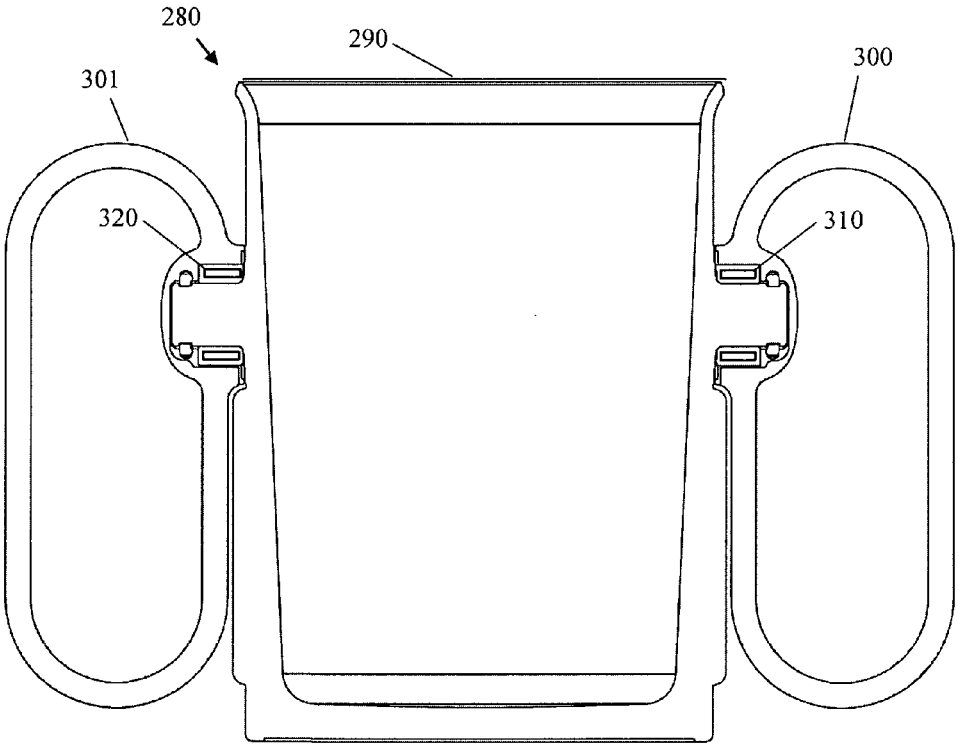
FIG. 27 is a cross-sectional view of the device in FIG. 26 and shows a roller hearing.

FIG. 27 is a cross-sectional side view of the device in FIG. 26 and shows a roller bearing 310 and 320 that is used as an alternative to a ball bearing.

The term "single gimbal" as used herein is intended to mean that the vessel 20 can rotate relative to the handle 50 about only one axis and is used in contrast to a double or multiple gimbals that allows the vessel to be rotated about two or more axes relative to the handle.

The terms "horizontal" and "vertical" are used herein to denote directions when the container is in its normal use and in particular when it is standing on a horizontal surface. It will be appreciated that such directions need not be exactly horizontal or exactly vertical.

I claim:

1. A household liquid-dispensing container comprising:

a vessel that is configured to hold a liquid and that has a base on which it can stand, an opening and at least one side; and a handle that is configured to be held by a user and that is attached to a side of the vessel by a single joint that comprises a bearing selected from the group consisting of a ball bearing and a roller bearing and forms a single gimbal between the handle and the vessel and that allows the handle to pivot about a single axis that extends directly above the centre of gravity of the vessel when the vessel base is standing on a horizontal surface, wherein the handle is configured so that it can rotate freely throughout the whole of a 360° arc about said axis and wherein said bearing is configured to allow the handle to rotate freely about the axis when held by a user, whereby the vessel, when held by the handle, will remain upright under gravity, whilst the handle remains freely moving throughout the whole said 360° arc.

2. A liquid container as claimed in claim 1, wherein the joint comprises a shaft attached to a side of the vessel and a corresponding recess in the handle that accommodates the shaft in a manner that allows relative rotation between the handle and the shaft.

3. A liquid container as claimed in claim 2, wherein the handle is held captive on the shaft while allowing relative rotation between the handle and the shaft.

4. A liquid container as claimed in claim 3, wherein the handle is held captive on the shaft while allowing relative rotation between the handle and the shaft by a clip or a projection provided on one of the handle or the shaft that engages with part of the other of the handle or shaft.

5. A liquid container as claimed in claim 1, wherein the handle comprises a loop that lies in a plane that also contains the axis.

6. A liquid container as claimed in claim 5, wherein the loop is a closed loop that extends around 360°.

7. A liquid container as claimed in claim 5 or claim 6, wherein the loop is elongated in the vertical direction, thereby allowing the handle to be grasped by all four fingers of a user's hand.

8. A liquid container as claimed in claim 1, wherein the joint is enclosed within a recess provided in the handle or in the side of the vessel.

9. A liquid container as claimed in claim 1, which has a capacity of 1 liter or less.

10. A liquid container as claimed in claim 1, which has a second handle that is also configured to be held by a user and that is attached to a side of the vessel by a second joint that also forms a single gimbal between the second handle and the vessel and that allows the handle to pivot about the same single axis as the first handle.

11. A liquid container as claimed in claim 1, which has only a single handle.

12. A liquid container as claimed in claim 1 wherein the axis lies in a vertical plane that bisects the vessel into two equal mass parts, when the vessel base is standing on a horizontal surface.

13. A liquid container as claimed claim 1, wherein the handle is configured to rotate about said axis through 360° alongside the vessel.

14. A liquid container as claimed in claim 1, wherein the handle is an elongated complete or partial loop having a long dimension and a short dimension and the axis is generally orthogonal to the long dimension.

15. A liquid container as claimed in claim 1, which includes only a single liquid-holding vessel.

16. A liquid container as claimed in claim 1, which is in the form of a drinking vessel.

17. A household liquid-dispensing container comprising:

a vessel that is configured to hold a liquid and that has a base on which it can stand, an opening and at least one side; and a handle that is configured to be held by a user and that is attached to a side of the vessel by a single joint that comprises a bearing selected from the group consisting of a ball bearing and a roller bearing and forms a single gimbal between the handle and the vessel and that allows the handle to pivot about a single axis that extends directly above the centre of gravity of the vessel when the vessel base is standing on a horizontal surface, wherein the handle is freely rotatable about the axis throughout a 360° arc by virtue of the joint.

* * * * *